US009402786B2

(12) United States Patent
Petrone

(10) Patent No.: US 9,402,786 B2
(45) Date of Patent: Aug. 2, 2016

(54) DEVICE/SYSTEM FOR MIXING LIQUIDS, DRUGS AND SOLUTIONS BEFORE ADMINISTRATION INTO THE HUMAN BODY

(75) Inventor: Dario Petrone, Pignola (IT)

(73) Assignee: LIFE MEDICAL DIVISION SRL, Aviano (IT)

( * ) Notice: Subject to any disclaimer, the term of this patent is extended or adjusted under 35 U.S.C. 154(b) by 0 days.

(21) Appl. No.: 13/387,834

(22) PCT Filed: Jul. 30, 2010

(86) PCT No.: PCT/EP2010/004676
§ 371 (c)(1),
(2), (4) Date: Jan. 30, 2012

(87) PCT Pub. No.: WO2011/012313
PCT Pub. Date: Feb. 3, 2011

(65) Prior Publication Data

US 2012/0127824 A1 May 24, 2012

(30) Foreign Application Priority Data

Jul. 30, 2009 (IT) ..... MI2009A1379

(51) Int. Cl.
*B01F 15/02* (2006.01)
*A61J 1/20* (2006.01)

(52) U.S. Cl.
CPC ..... *A61J 1/2096* (2013.01); *A61J 1/2089* (2013.01); *A61J 1/2062* (2015.05)

(58) Field of Classification Search
CPC ..... A61B 5/1405; A61J 1/2096; A61J 1/062
USPC ..... 366/132, 137, 182.1, 182.2, 182.3, 366/182.4, 189, 190, 192, 267, 268
See application file for complete search history.

(56) References Cited

U.S. PATENT DOCUMENTS 3,012,863 A * 12/1961 Feichtmeir et al. ..... 422/514
3,276,472 A * 10/1966 Jinkens ..... A61M 39/223 137/556

(Continued)

FOREIGN PATENT DOCUMENTS

WO 2008048323 A1 4/2008

OTHER PUBLICATIONS

International Search Report dated Jun. 12, 2010 in PCT/EP2010/004676.
Written Opinion of the International Searching Authority in PCT/EP2010/004676 (PCT/ISA/237).

*Primary Examiner* — Tony G Soohoo
*Assistant Examiner* — Anshu Bhatia
(74) *Attorney, Agent, or Firm* — Vorys, Sater, Seymour and Pease LLP

(57) ABSTRACT

A reusable and versatile device/system for mixing liquid drugs or solutions, before their administration into the human body. Mixing is carried out inside an entirely closed circuit, avoiding any contacts between the phases to be mixed and the external atmosphere. Closure of the circuit is realized partly by integral and indissoluble (permanent) connections and partly by reversible connections, such as vascular accesses, unidirectional or bidirectional check valves (NRV), or any other device which allows the creation of a closed circuit even after use, both to the system and the connected accessories, thus minimizing the risks of possible contaminations and/or infections to the patients.

24 Claims, 9 Drawing Sheets

(56) References Cited

U.S. PATENT DOCUMENTS 4,743,229 A * 5/1988 Chu ..... 604/82
6,068,617 A * 5/2000 Richmond ..... 604/255
2007/0088252 A1 4/2007 Pestotnik et al.
2008/0140021 A1 6/2008 Richmond
2008/0228153 A1* 9/2008 Shacham ..... 604/317

* cited by examiner glued
glued
glued

DEVICE/SYSTEM FOR MIXING LIQUIDS, DRUGS AND SOLUTIONS BEFORE ADMINISTRATION INTO THE HUMAN BODY

CROSS-REFERENCE TO RELATED APPLICATIONS

This application is a §371 National Stage Application of International Application No. PCT/EP2010/004676, filed on 30 Jul. 2010, claiming the priority of Italian Patent Application No. MI2009A001379 filed on 30 Jul. 2009.

FIELD OF THE INVENTION

Prior Art

Due to the instability of the components mixed together, many injectable solutions cannot be produced in a ready-to-use form and stored as such. Frequently, their constituting components (liquid or solid) must be stored separately and the final solutions are not prepared until the moment of use, by proper blending of the respective constituents. The preparation of solutions to be administered to patients is always a delicate and laborious operation, both for the necessity of controlling the exact amounts of the components used and for minimizing the risk of bacterial contaminations, sources of possible infections. These operations are extremely burdensome for the designated operator. In case of repeated administrations, typically in a hospital environment, it is appropriate to make use of pre-established devices suitable for mixing liquids with liquids and/or solids, which can be drawn from suitable containers.

An example of a currently marketed device for mixing drugs, liquids or solutions inside the human body is shown in FIG. 1: these are made of a single body (1A) assembled to spikes or similar devices (2A) adapted to pierce suitable containers such as bottles with solid drugs or bags/bottles with saline or other liquids. The liquid flow within the system is ensured by the drawing/infusion movement of a needleless syringe, suitably inserted into an open cone (3A) of the single body, also serving as a diverter. In operation, the syringe is filled with saline, drawing the required liquid from a bag connected to the single body (1A); then the diverter is rotated by 90° and the liquid in the syringe is forced into the solid drug container, connected to the diverter; once mixing is completed, the syringe is filled by drawing, it is separated from the inlet point of the device (3A) for subsequent filling of a bag or bottle intended for administration to the patient.

FIG. 2 shows a device similar to the previous one and having the same functions, further provided with a specific housing (2B) adapted to connect the single body (1B) to larger bottles.

Known devices of the type shown in the FIGS. 1-2 have the following problems:

1. The circuit is partially open: liquid residues are formed in the open cone (3A, 3B), which are exposed to contact with atmosphere and thus to bacterial contamination. The points (2A) and (2B) are also exposed to the atmosphere upon connection/disconnection of the bag or bottle.

2. The system is of a disposable type: each mixing operation involves the use and disposal of one device, with a consequent increase of daily costs including that of disposal.

3. The replacement of the disposable devices involves repeated opening of the circuit at the points (2A) and (2B), during which the inside of the bags/bottles comes into contact with the atmosphere, increasing the risk of contamination of the contents. The frequent manipulation of the spikes for the connection of the disposable devices is also a possible source of contamination.

4. At the end of all the daily mixing operations, substantial amounts of drugs, sometimes very expensive, may be left in the bottles which have lost sterility due to contact with air (e.g. the pierced rubber cap of the bottle remains open after removal of the spike); the expiry date of the open product is down to a few hours, thus the residual amounts of drug have to be disposed of, with a consequent increase in costs.

5. Substantial waste of time, since after mixing it is necessary to disconnect the syringe from the device and to fill the bag for patient therapy using a needle or a spike to be mounted on the cone thereof (frequent manipulations with an associated risk of contaminations).

6. The technician who carries out the above operations is exposed to the risk of accidental pricks and/or contact with vapours coming from the liquid circulating in the system.

7. The possible contamination of the device is also transmissible to the patient in the following administration step through contamination of bags and infusion sets.

SUMMARY OF THE INVENTION

Object of the present finding is a device and system for mixing drugs, liquids or solutions intended for administration to a patient by injection or infusion. The device is an entirely closed circuit, reusable with no risks of bacterial contaminations, and highly versatile in that it can be modified in terms of number of channels and access points.

In its general embodiment, shown in FIG. 3, the device object of the invention comprises a main hollow body (1C) adapted to circulate a liquid therein and comprising one or more diverters (2C), by which the main body can be put in communication alternatively with one or more devices (3C) for drawing/infusing liquids (3C), one or more containers for liquids (4C) and one or more containers for solids (5C), said main body comprising reversible connecting means (6C, 7C, 8C) aimed at connecting the elements (3C, 4C, 5C) and realized so as to permanently prevent any contacts between the inner circulating liquid and the external atmosphere. The device thus assembled realizes an entirely closed circuit for mixing liquid and solid phases intended for a patient, which is reusable and ensures complete sterility inside the circuit minimizing necessary manipulations by the operator and risks associated therewith.

In operation, the device is connected to the element (3C) (typically a syringe), to the container for liquids (4C) (containing saline for example), and to the container for solids (5C) (containing the substance in solid form to be dissolved, generally a drug). The diverter (2C) is adjusted so as to put the elements (3C) and (4C) in communication; the syringe is then operated in drawing mode and the saline contained in (4C) is drawn in (3C). After having drawn the required volume of solution, the movement of the syringe is stopped and the diverter (2C) is adjusted so as to put the elements (3C) and (5C) in contact with each other; the syringe is then operated in infusion mode and the saline is forced into the container for solids (5C), dissolving the drug contained therein, possibly with the aid of vibrations or other stimulations. After dissolution of the drug, the syringe is actuated again in drawing mode and the drug solution coming from (5C) transfers to (3C). The saline container (4C) is replaced with an empty container (e.g. bag for patient infusion), and the diverter (2C) is adjusted so as to put the elements (3C) and (4C) in contact with each other; the syringe is finally actuated in infusion mode and the drug solution is forced into the empty container (4C). The latter can be disconnected and stored separately or used immediately for administration to the patient by traditional methods.

DETAILED DESCRIPTION

Figure 1:
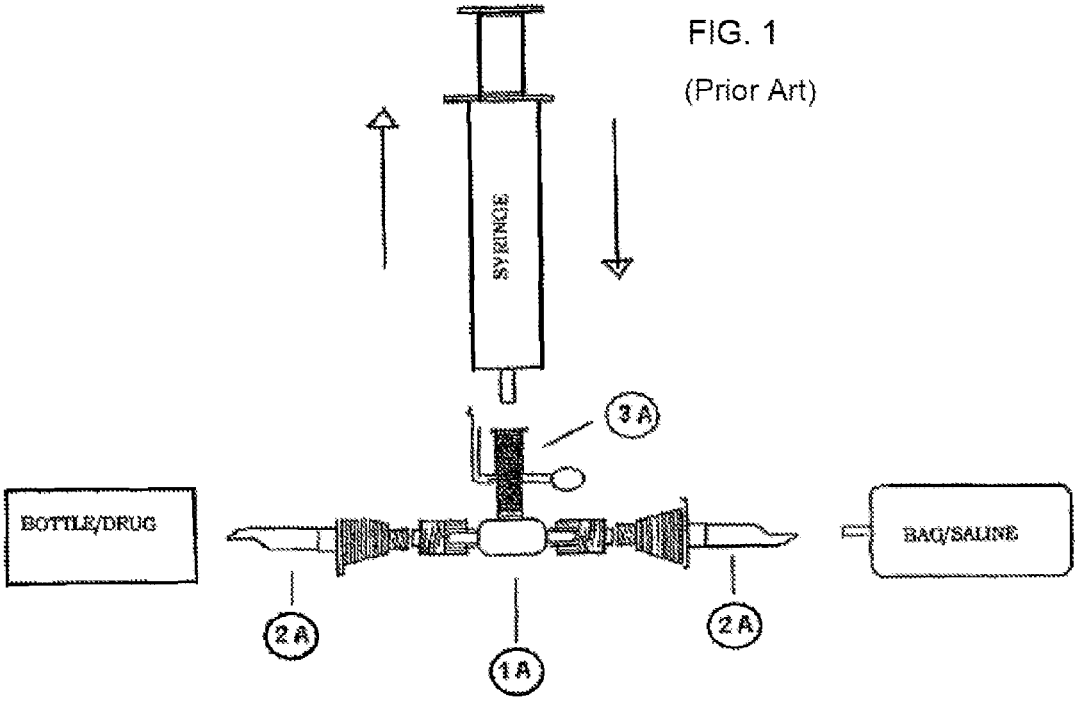
FIG. 1 (Prior Art)
FIG. 1 shows an example of a currently marketed device for mixing drugs, liquids or solutions inside the human body.
Figure 2:
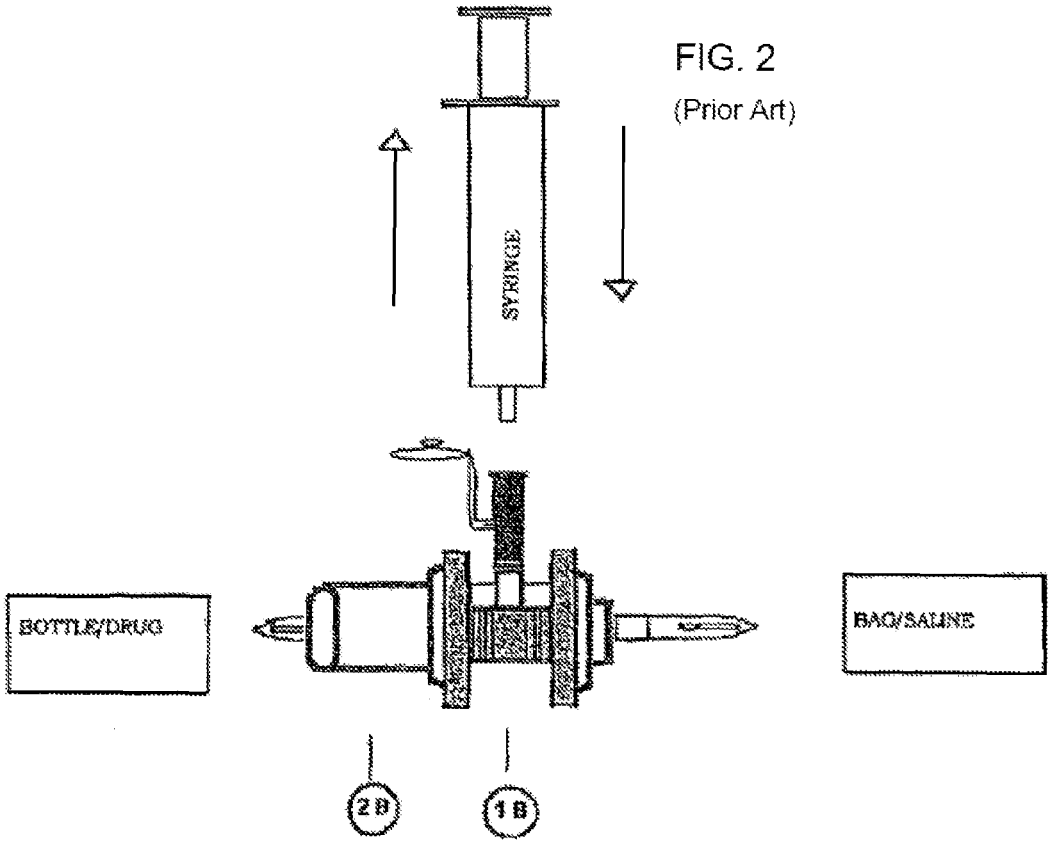
FIG. 2 (Prior Art)
FIG. 2 shows a known device similar to the device of FIG. 1.
Figure 3:
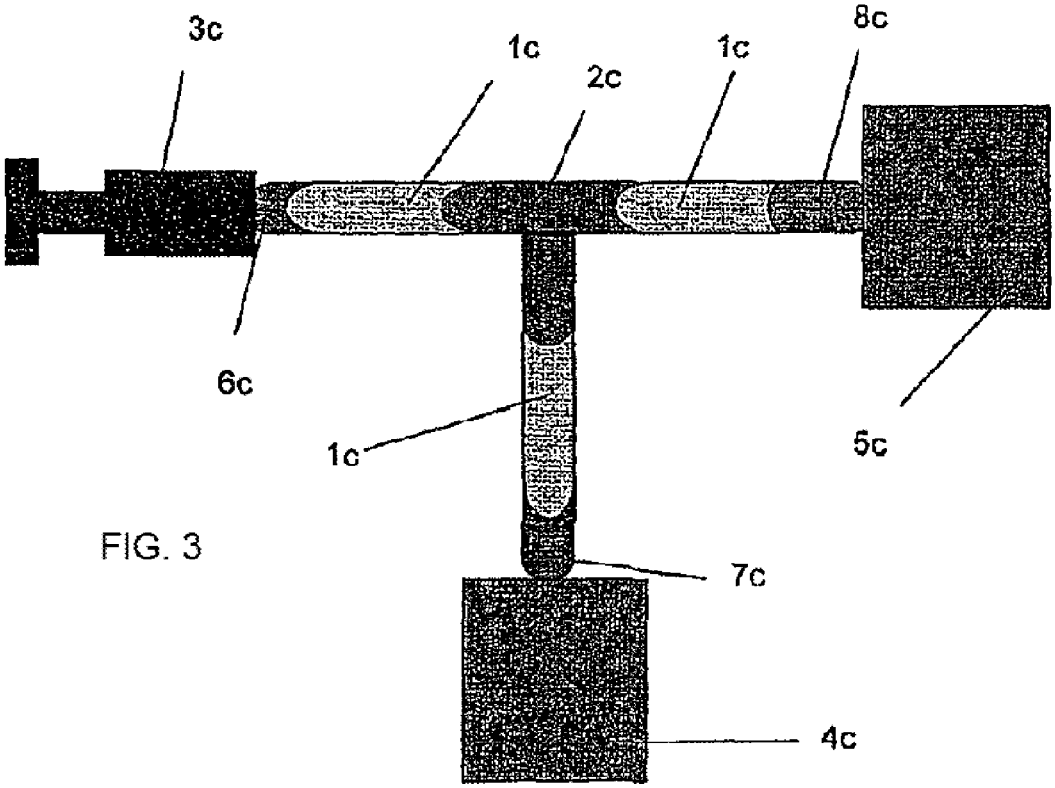
FIG. 3 shows an embodiment of a device of the present invention.

For the purposes of the present invention the term "closed circuit" identifies a circuit in which the liquid, circulating therein, is always and at any point thereof isolated from contact with the atmosphere external to the circuit. The elements of the closed circuit can be connected with each other by means of irreversible connections (integral and indissoluble) and/or reversible connections, typically without the use of needles. Irreversible connections are realized e.g. by glueing, sealing, welding, etc.; the obtained junctions are completely impervious to the passage of liquid or air, thus avoiding any contacts between the liquid and the atmosphere at the junction point.

Reversible connections are also realized so as to avoid any contacts between the liquid and the atmosphere at the junction point: this isolation takes place not only during the connected state, but also during the connection/disconnection procedures and during the disconnected state.

Suitable elements for realizing these connections are known per se, e.g. vascular accesses (luer locks), unidirectional/bidirectional check valves, connectors with extensions, etc.; these elements generally comprise membranes, tongues, or other guard systems mounted at the ends of the channel running therethrough; in the connected state, the guard systems are generally forced into an open position and the channel lumen is pervious to the passage of liquid; upon disconnection, the lumen of the channel is immediately blocked by the passive movement of the guard systems and the liquid therein becomes isolated from the external atmosphere.

Except for the above mentioned characteristics, there is no principle limitation to the type, position and number of connections that constitute the closed circuit device object of the invention. For example, the main body (1C) can be constituted by a single element or can comprise in its extension several known functional elements (e.g. rollers, extensions, air bubble traps, male/male connections, connectors for large or small containers, spikes, etc.) connected with each other (in a reversible or irreversible manner) so as to always form a closed circuit in the sense indicated above.

Preferably, all the connections used in the invention are of the irreversible type, with the exclusion of those strictly necessary to allow the disconnection of containers for liquids and solids. Therefore, the single body portion between the diverter (2C) and the container (4C) preferably contains a single reversible connection, which allows separating the container itself; the same is true for the length between (2C) and (5C).

The reversible connection can be placed at any point of the length in question, that is to say in a more or less proximal position with respect to the container to be separated. For example, if the length 2C-3C comprises three functional elements Fa, Fb, Fc therein (structure [2C-Fa-Fb-Fc-3C]), the reversible connection can placed be at any height of the length, resulting after the separation in the formation of any one of the following pairs: [2C]+[Fa-Fb-Fc-3C], or [2C-Fa]+[Fb-Fc-3C], or [2C-Fa-Fb-]+[Fc-3C], or [2C-Fa-Fb-Fc-]+[3C]. In all these cases, each of the separated pairs constitutes an entirely protected closed circuit per se.

Preferably, vascular accesses and check valves are used as reversible connection elements. The check valves are particularly useful when mounted in proximity of the container for solids, preventing in that position a backflow towards the syringe during the infusion step (3C)→(5C), or an opposite backflow towards the container (5C) during the drawing step (3C)←(5C).

Preferably, the connections between the diverter (2C) and the elements directly connected thereto, are of the irreversible type.

The isolation characteristics of the above cited connections allow an entirely closed circuit to be formed, which remains such also in the replacement steps of the containers for solids/liquids and of the syringe, thus safeguarding the sterility inside the device; in their turn, the containers and the syringe may be provided with corresponding connections, which safeguard sterility inside said peripheral devices even during and after the connection/disconnection steps.

Generally, the containers for solids used in the invention are bottles or similar containers containing a drug in solid form which needs to be dispersed in a liquid phase. Generally, the containers for solutions are bags or similar containers containing water, liquid state drugs, saline solutions, or other liquid phases which need to be mixed with a drug in solid form.

The invention is now illustrated with reference to more detailed embodiments.

Figure 4:
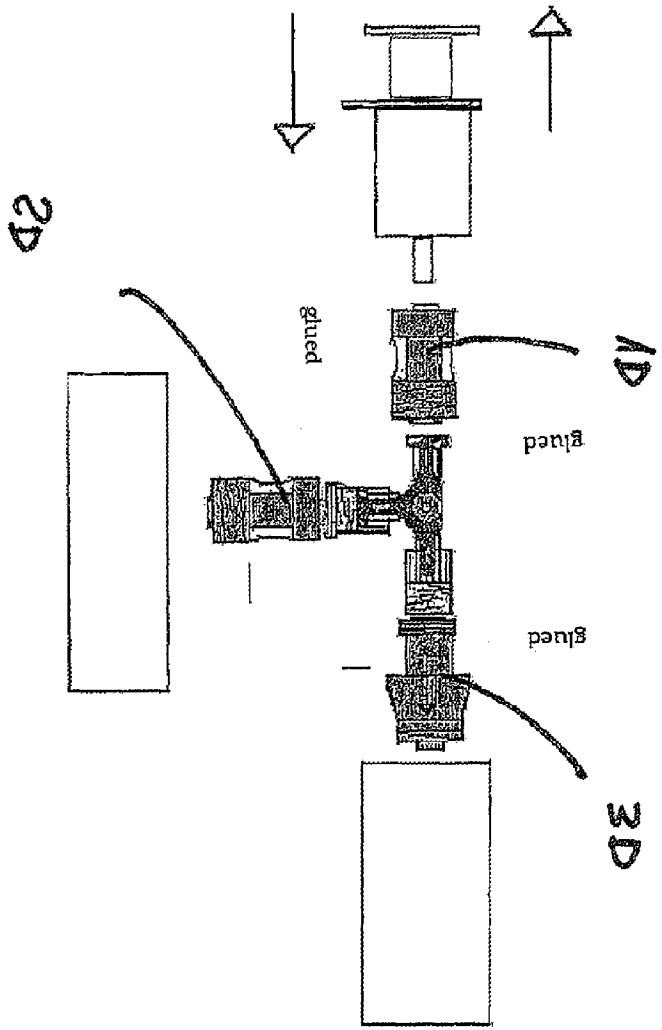
FIG. 4 shows a first more detailed embodiment of a device of the present invention.

FIG. 4 shows a first more detailed embodiment, where the reversible connections are made by means of quick connections (1D, 2D, 3D) and one of these (3D) comprises a bidirectional check valve, useful for preventing a reflux in a direction opposite to that imposed by the syringe.

Figure 5:
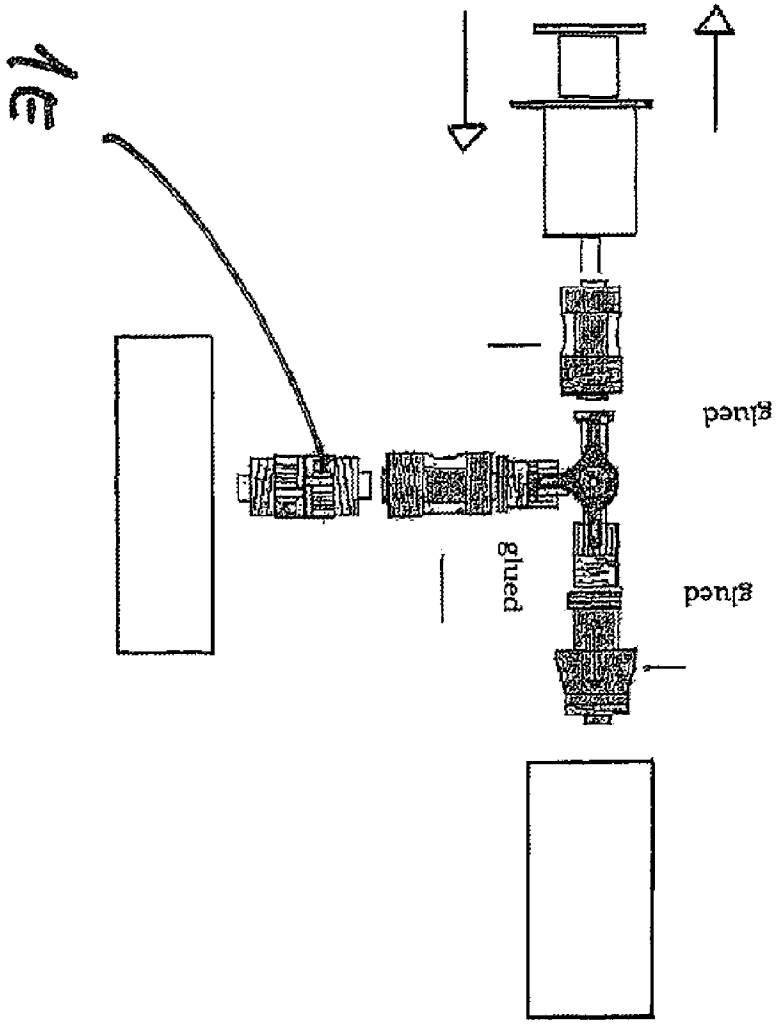
FIG. 5 shows interposing a male/male coupling in a length between a diverter and a container for liquids.

FIG. 5 also shows the possibility of interposing a male/male coupling (1E) in the length between the diverter and the container for liquids.

Figure 6:
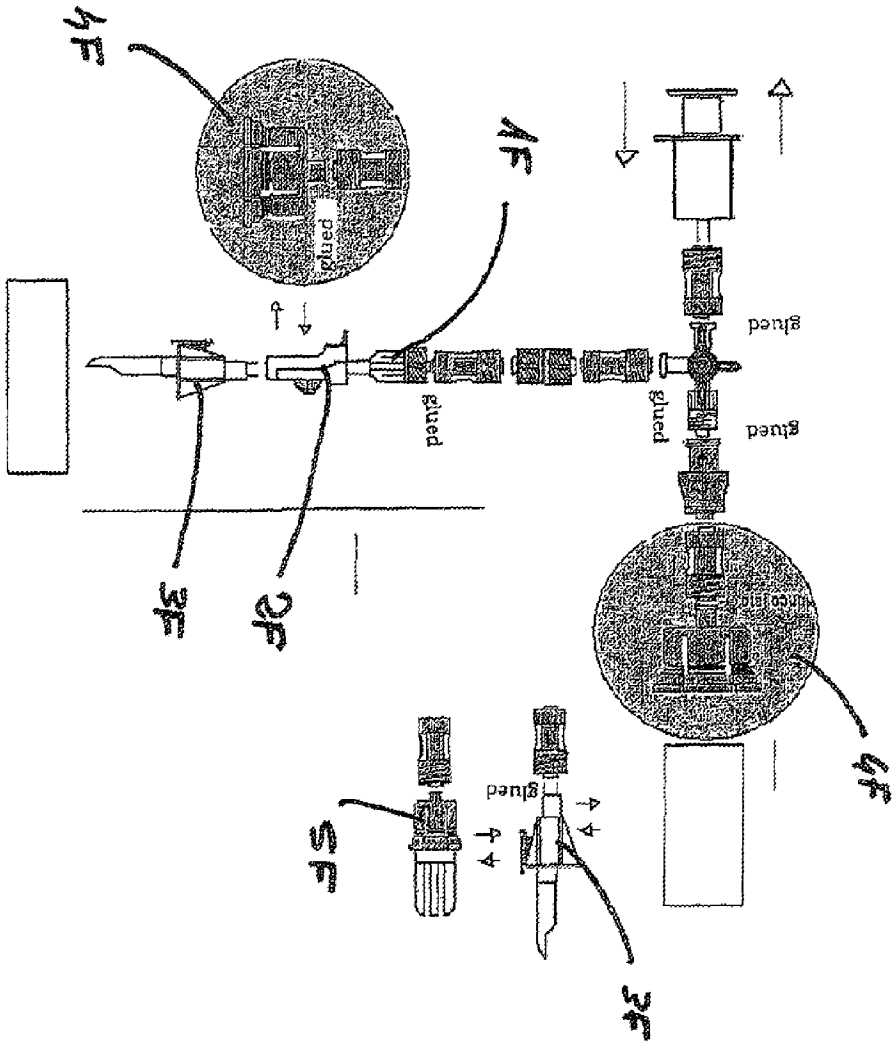
FIG. 6 shows a second detailed embodiment of a device of the present invention.

FIG. 6 shows a second detailed embodiment of the invention; this includes all the elements of FIG. 5, specifying a connection option between the male/male coupling and the container for liquids: such connection can be realized e.g. by connecting in series a connector with an extension (1F), a roller (2F) for adjusting the flow, and a spike (3F) (or a connector for large or small bottles (4F/5F)).

Figure 7:
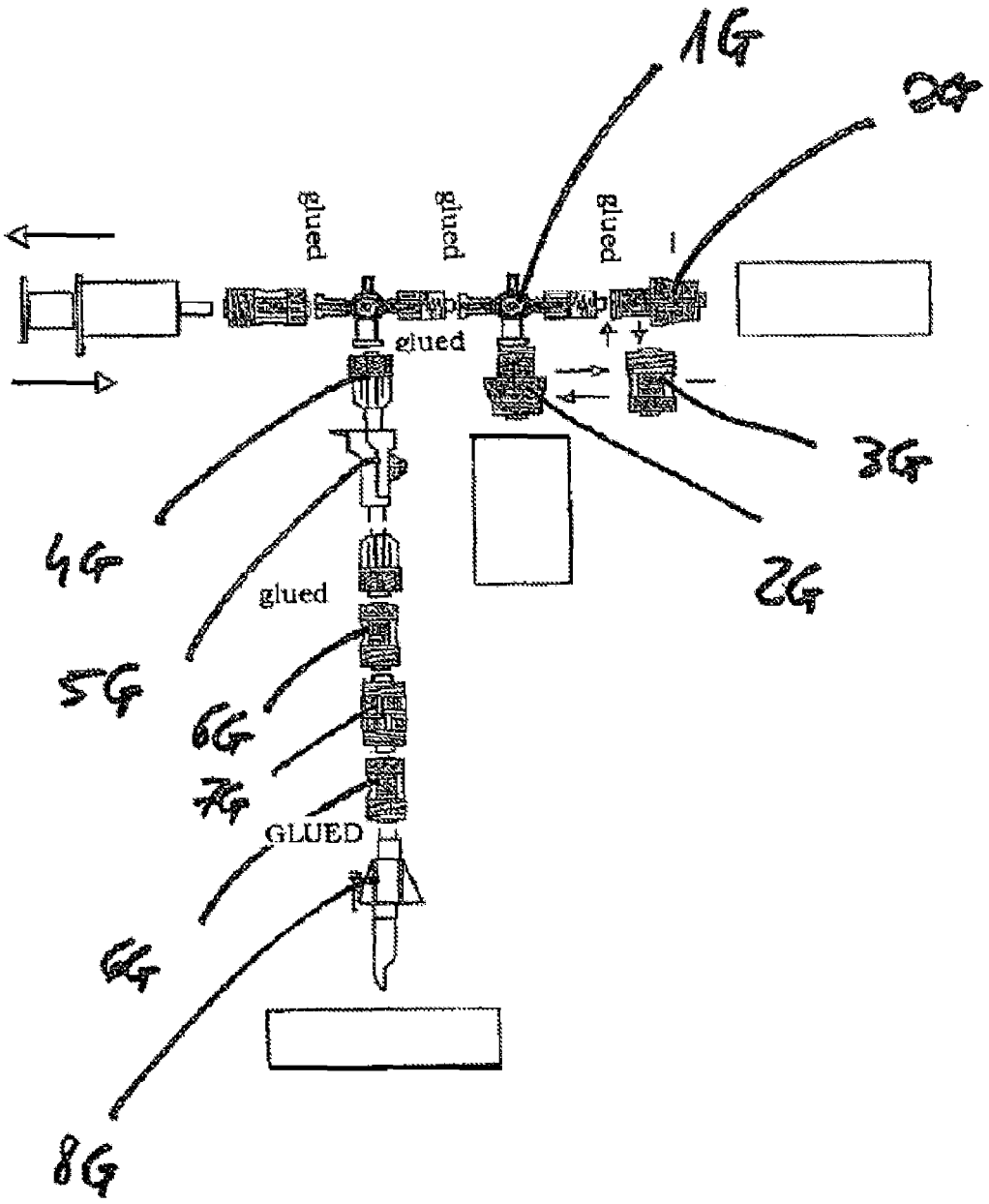
FIG. 7 shows a third detailed embodiment of a device of the present invention.

FIG. 7 shows a third detailed embodiment of the invention; this includes, in addition to previously discussed elements, a second diverter (1G) which gives access to an additional channel connecting the main body with a further container for solids; the two containers for solids are connectable e.g. by means of a bidirectional check valve (2G) or a vascular access (3G). The connection with the container for liquids can be realized e.g. by connecting in series a connector (4G), a roller (5G) for adjusting the flow, two vascular accesses (6G), a male/male coupling (7G), and a spike (8G). This embodiment is useful for example when a solid drug has to be dissolved in two different liquids, or when it is necessary to dissolve a drug in a first liquid, and then mix it with a second drug already in the liquid state.

Figure 8:
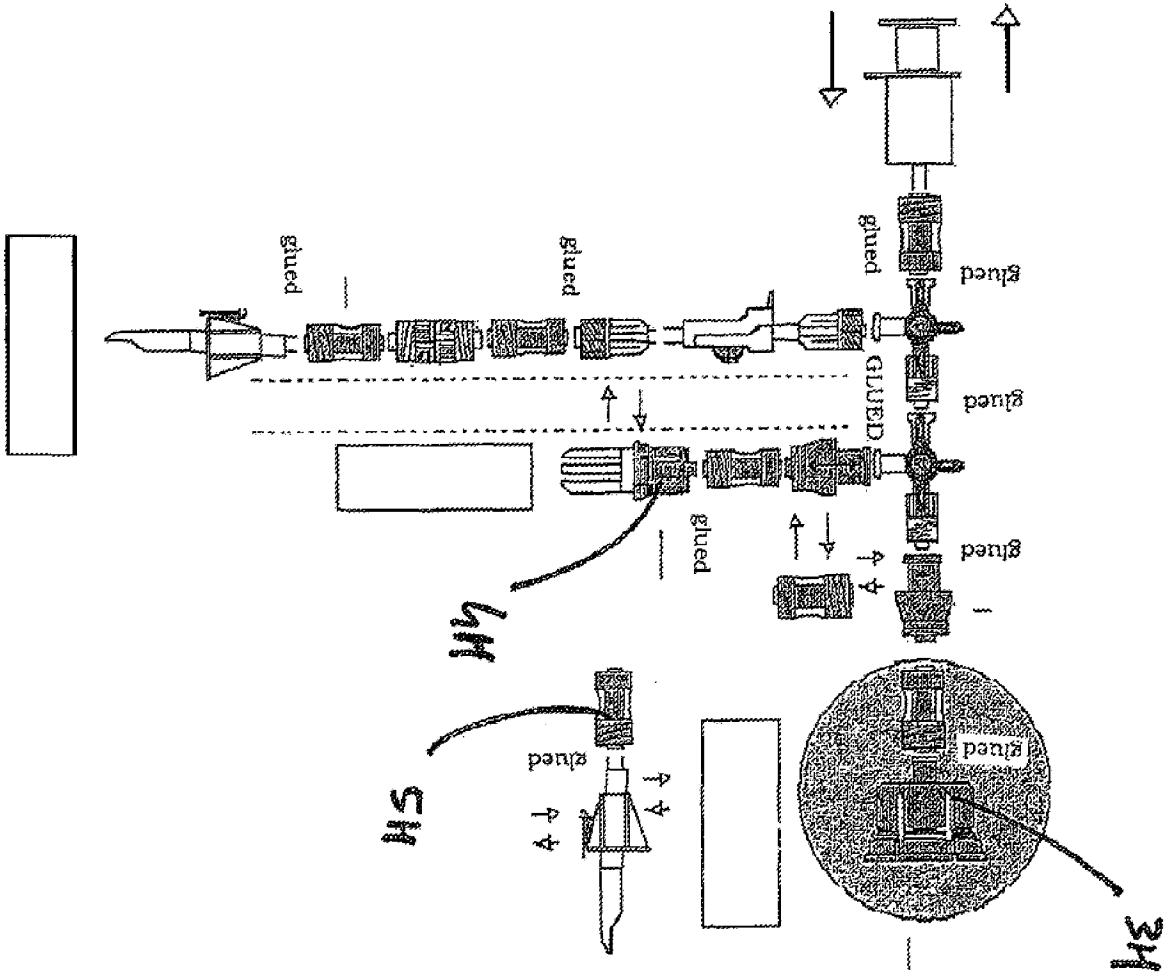
FIG. 8 shows a fourth detailed embodiment of a device of the present invention.

FIG. 8 shows a fourth detailed embodiment of the invention; this includes all the elements and functions illustrated in FIG. 7, specifying the presence of couplings for large or small containers (3H, 4H), even replaceable with spikes (5H).

Figure 9:
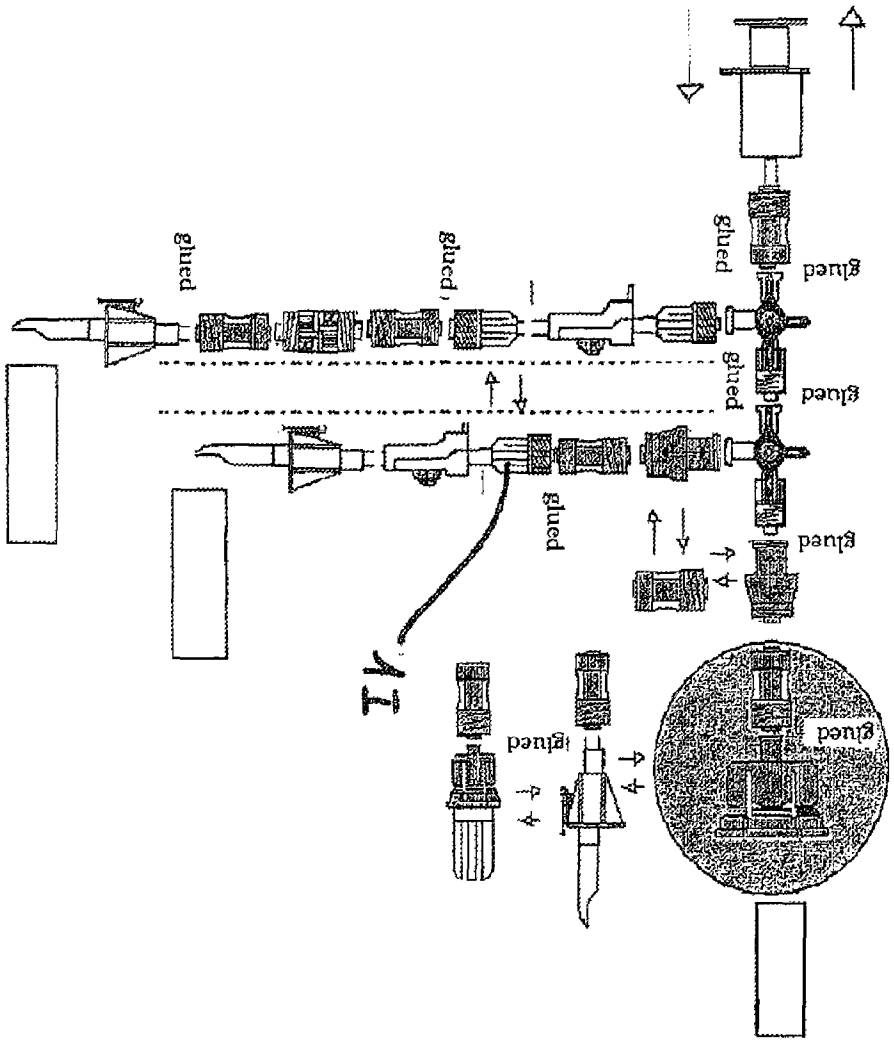
FIG. 9 shows a fifth detailed embodiment of a device of the present invention.

FIG. 9 shows a fifth detailed embodiment of the invention; this includes all the elements and functions illustrated in FIG. 7, specifying the presence of a further connector with an extension (1I) along the additional channel.

In brief, the present finding provides a system for mixing drugs, liquids and solutions without disconnection of the syringe at any time using connection systems (irreversible and reversible) capable of obtaining a closed circuit system which minimizes the possibility of contaminations before and during the therapies in the span of a day (system which is reusable and versatile in its composition).

Advantageously, it is thus possible to protect patients from infections, to protect operators from accidental pricks and exhalations of toxic vapours of drugs.

The particular protection of the circuit allows reuse of the same for a substantially unlimited number of mixing operations, without having to replace the entire device after every mixing operation as is known in the art; for the same reasons it is possible to leave residues of unused drugs and solutions in the containers for days, with no risks of bacterial contaminations of the products contained therein. The economic loss related to the replacement of the device and the disposal of the residues of unused drugs is thus dramatically reduced.

The invention claimed is:

1. A method comprising mixing solid and liquid phases using a mixing device, wherein the mixing device is an entirely air-tight closed circuit isolated from contact with an atmosphere external to the air-tight closed circuit, the mixing device comprising:

a main hollow body comprising a three port diverter valve having exactly three ports and exactly three conduits respectively extending from and in communication with a respective said port of the diverter valve, the hollow body diverter valve for allowing reversible inner liquid circulation alternately between only a first said conduit and a second said conduit or between only the first said conduit and a third said conduit;

the diverter valve arranged to put the main hollow body in communication alternatively with:

a device for drawing/infusing liquids, a container for liquids of the liquid phase, and a container for solids of the solid phase;

wherein the first conduit has a first end in communication with a first said port of the diverter valve and an opposed second end in reversible communication with a first reversible connector adapted to connect the main hollow body first conduit to the device for drawing/infusing liquids, wherein the second conduit has a first end in communication with a second said port of the diverter valve and an opposed second end in communication with a second reversible connector adapted to connect the main hollow body second conduit to the container for liquids, and wherein the third conduit has a first end in communication with a third said port of the diverter valve and an opposed second end in communication with a third reversible connector adapted to connect the main hollow body third conduit to the container for solids, wherein each of the first reversible connector, the second reversible connector, and the third reversible connector is selected from at least one member of the group consisting of luer locks, bidirectional check valves, connections with extensions having guard systems mounted at the ends of a channel running therethrough, and combinations thereof, wherein each of the first reversible connector, the second reversible connector, and the third reversible connector provides a seal to permanently prevent any contacts between the inner circulating liquid and the atmosphere external to the air-tight closed circuit in each of:

a connected state, wherein the main hollow body is connected to at least one of the device for drawing/infusing liquids, the container for liquids, and the container for solids via, respectively, the first reversible connector, the second reversible connector, and the third reversible connector, a connection/disconnection procedure, wherein the main hollow body is being connected/disconnected to/from at least one of the device for drawing/infusing liquids, the container for liquids, and the container for solids via, respectively, the first reversible connector, the second reversible connector, and the third reversible connector, and a disconnected state, wherein the main hollow body is disconnected from at least one of the device for drawing/infusing liquids, the container for liquids, and the container for solids via, respectively, the first reversible connector, the second reversible connector, and the third reversible connector.

wherein the liquid phase comprises a suitable solvent, wherein the container for liquids, containing the suitable solvent, after suitable drawing therefrom, is replaced with a patient infusion bag, into which mixed solution of the solid and liquid phases is to be collected.

2. The method according to claim 1, wherein the mixing device comprises one or more functional elements, integrated in the air-tight closed circuit by means of connections which permanently avoid any contacts between the inner circulating liquid and the atmosphere external to the air-tight closed circuit.

3. The method according to claim 2, wherein the functional elements are selected from the group consisting of rollers, extensions, air bubble traps, male/male connections, connectors for large or small containers, spikes, and other accessories for infusing devices.

4. The method according to claim 1, wherein each container for solids and liquids is connectable to the mixing device by a single reversible connection.

5. The method according to claim 1, wherein any other connection among the elements making up the mixing device is irreversible.

6. The method according to claim 1, wherein the mixing device further comprises guard systems comprising membranes or tongues configured, in a connected condition, to be forced in an open position by the passage of a liquid, and, upon disconnection, to passively move in a closed position to block a lumen of the channel to isolate from the external atmosphere the liquid contained in the main hollow body.

7. The method according to claim 6, wherein each of the first reversible connector, the second reversible connector, and the third reversible connector comprises extensions having the guard systems mounted at the ends of a channel running therethrough.

8. The method according to claim 1, wherein the suitable solvent is a physiological solution.

9. A method comprising mixing solid and liquid phases using a mixing device, wherein the mixing device is an entirely air-tight closed circuit isolated from contact with an atmosphere external to the air-tight closed circuit, the mixing device comprising:

a main hollow body comprising a three port diverter valve having exactly three ports and exactly three conduits respectively extending from and in communication with a respective said port of the diverter valve, the hollow body diverter valve for allowing reversible inner liquid circulation alternately between only a first said conduit and a second said conduit or between only the first said conduit and a third said conduit;

the diverter valve arranged to put the main hollow body in communication alternatively with:

a device for drawing/infusing liquid, a container for liquids of the liquid phase, and a container for solids of the solid phase;

wherein the first conduit has a first end in communication with a first said port of the diverter valve and an opposed second end in reversible communication with a first reversible connector adapted to connect the main hollow body first conduit to the device for drawing/infusing liquids, wherein the second conduit has a first end in communication with a second said port of the diverter valve and an opposed second end in communication with a second reversible connector adapted to connect the main hollow body second conduit to the container for liquids, and wherein the third conduit has a first end in communication with a third said port of the diverter valve and an opposed second end in communication with a third reversible connector adapted to connect the main hollow body third conduit to the container for solids, wherein each of the first reversible connector, the second reversible connector, and the third reversible connector is selected from at least one member of the group consisting of luer locks, bidirectional check valves, connections with extensions having guard systems mounted at the ends of a channel running therethrough, and combinations thereof, wherein each of the first reversible connector, the second reversible connector, and the third reversible connector provides a seal to permanently prevent any contacts between the inner circulating liquid and the atmosphere external to the air-tight closed circuit in each of:

a connected state, wherein the main hollow body is connected to at least one of the device for drawing/infusing liquids, the container for liquids, and the container for solids via, respectively, the first reversible connector, the second reversible connector, and the third reversible connector, a connection/disconnection procedure, wherein the main hollow body is being connected/disconnected to/from at least one of the device for drawing/infusing liquids, the container for liquids, and the container for solids via, respectively, the first reversible connector, the second reversible connector, and the third reversible connector, and a disconnected state, wherein the main hollow body is disconnected from at least one of the device for drawing/infusing liquids, the container for liquids, and the container for solids via, respectively, the first reversible connector, the second reversible connector, and the third reversible connector, wherein the mixing device sequentially puts parts of the mixing device in fluid communication according to the following steps:

A— the liquid phase from the container for liquids flows to the device for drawing/infusing liquids to draw the liquid phase into the device for drawing/infusing liquids;

B— the liquid phase from the device for drawing/infusing liquids flows to the container for solids to force the liquid phase in the container for solids to form a solution with the solids of the solid phase in the container for solids by operating the device for drawing/infusing liquids in infusion mode;

C— the solution from the container for solids flows back to the device for drawing/infusing liquids to draw the solution so obtained into the device for drawing/infusing liquids operated in drawing mode;

D— the solution from the syringe flows back to the container for liquids to push the solution into the container for liquids when the syringe is operated in infusion mode, wherein the container for liquids of step D may be the same or different than the container for liquids of step A.

10. The method according to claim 9, wherein the container for liquids is selected from the group consisting of a bag and a bottle.

11. The method according to claim 9, wherein each of the first reversible connector, the second reversible connector, and the third reversible connector are luer locks.

12. The method according to claim 9, wherein the mixing device comprises one or more functional elements, integrated in the air-tight closed circuit by means of connections which permanently avoid any contacts between the inner circulating liquid and the atmosphere external to the air-tight closed circuit.

13. The method according to claim 9, wherein the mixing is for preparing solutions to be injected or infused into a patient.

14. The method according to claim 9, wherein the container for liquids, containing a suitable solvent, after suitable drawing therefrom, is replaced with a patient infusion bag, into which the mixed solution is to be collected.

15. The method according to claim 14, wherein the suitable solvent is a physiological solution.

16. The method according to claim 9, wherein each of the first reversible connector, the second reversible connector, and the third reversible connector is selected from at least one member the group consisting of unidirectional check valves and bidirectional check valves.

17. The method according to claim 9 wherein the solid phase comprises a drug located within the container for solids, wherein the mixing mixes the drug in solid form with the liquid in the container for solids to dissolve the drug in the liquid phase for preparing drug-containing solutions, and then the drug-containing solution is recovered and then injected or infused into a patient.

18. The method according to claim 9, wherein the functional elements are selected from the group consisting of rollers, extensions, air bubble traps, male/male connections, connectors for large or small containers, spikes, and other accessories for infusing devices.

19. The method according to claim 9, wherein each container for solids and liquids is connectable to the device by a single reversible connection.

20. The method according to claim 9, wherein any other connection among the elements making up the device is irreversible.

21. The method according to claim 9, wherein the mixing device further comprises guard systems comprising membranes or tongues configured, in a connected condition, to be forced in an open position by the passage of a liquid, and, upon disconnection, to passively move in a closed position to block a lumen of the channel to isolate from the external atmosphere the liquid contained in the main hollow body.

22. The method according to claim 21, wherein each of the first reversible connector, the second reversible connector, and the third reversible connector comprises extensions having the guard systems mounted at the ends of a channel running therethrough.

23. The method according to claim 9, wherein the solid phase comprises a drug in solid form located within the container for solids, wherein the liquid phase is the liquid in the container for liquids, wherein the mixing mixes the drug in solid form and the liquid in the container for solids to dissolve the drug in the liquid phase for preparing the solution wherein the solution comprises the drug.

24. The method according to claim 23, wherein the recovered solution is injected or infused into a patient.

* * * * *